United States Patent [19]

Kanazawa

[11] 4,115,770

[45] Sep. 19, 1978

[54] A BUZZER HAVING ADJUSTABLE BUZZER SOUND

[75] Inventor: Masayuki Kanazawa, Ishioka, Japan

[73] Assignee: Kabushiki Kaisha Seikosha, Japan

[21] Appl. No.: 690,522

[22] Filed: May 27, 1976

[30] Foreign Application Priority Data

Jun. 9, 1975 [JP] Japan ..... 50/78618[U]

[51] Int. Cl.[2] ..... G10K 9/12

[52] U.S. Cl. ..... 340/396; 340/392; 340/384 R

[58] Field of Search ..... 340/396, 402, 388, 392, 340/384 R

[56] References Cited

U.S. PATENT DOCUMENTS

| | | | |
|---|---|---|---|
| 3,518,667 | 6/1970 | Hanna | 340/388 |
| 3,553,686 | 1/1971 | Carter | 340/402 |
| 3,950,744 | 4/1976 | Stephens | 340/402 |
| 3,974,499 | 8/1976 | Shigemori | 340/396 |

FOREIGN PATENT DOCUMENTS

| | | | |
|---|---|---|---|
| 22,782 of | 1913 | United Kingdom | 340/392 |

*Primary Examiner*—Harold I. Pitts

*Attorney, Agent, or Firm*—Robert E. Burns; Emmanuel J. Lobato; Bruce L. Adams

[57] ABSTRACT

A small-sized buzzer comprises a vibrationally driven vibrator mounted within a case together with drive circuitry for electromagnetically actuating the vibrator. A screw member is threaded into the case at a location spaced from and opposite the free end of the vibrator so as to be repeatedly struck by the vibrator free end during its vibration to produce a buzzer sound. The buzzer sound can be varied by turning the screw member to adjust its spacing from the vibrator.

3 Claims, 4 Drawing Figures

A BUZZER HAVING ADJUSTABLE BUZZER SOUND

BACKGROUND OF THE INVENTION

The present invention relates to a small buzzer and enables to control output sound.

In a conventional buzzer, a case contains a driving means including a yoke and a coil round the yoke, and a vibrator actuated by the driving means, so that the vibrator strikes the case or a sound film provided in the case producing the buzzing sound.

In such a type of buzzer, the quality of the output sound is much influenced by the clearance between the vibrator and the case or the sound film. Therefore in such a conventional buzzer an, error of the clearance made during manufacture has a direct effect on the output sound resulting in a scattering output sound and high rate in the number of rejects.

The present invention intends to eliminate the above disadvantage.

SUMMARY OF THE INVENTION

According to the present invention there is provided a vibrator carrying a magnet at its free end portion, a driving means for vibrationally driving the vibrator including a yoke and a coil about said yoke, and an impact member which is repeatedly struck by said vibrator producing the buzzer sound. The impact member is threaded into a buzzer case so as to be movable towards and away from said vibrator to accordingly vary the buzzer sound.

One object of the present invention is to provide a buzzer whose output sound can be controlled easily.

The above object other objects and characteristic features of the present invention will become evident and will be more readily understood from the following description and claims taken in conjunction with the accompanying drawings; in which

DETAILED DESCRIPTION OF PREFERRED EMBODIMENT

Figure 1:
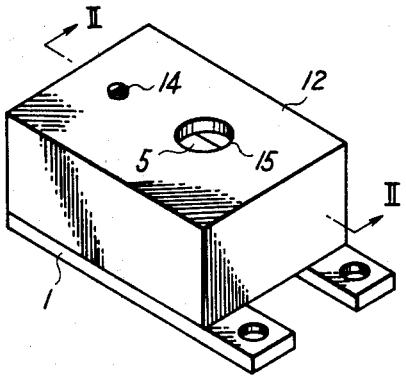
FIG. 1 is a perspective view of a buzzer according to the present invention.
Figure 2:
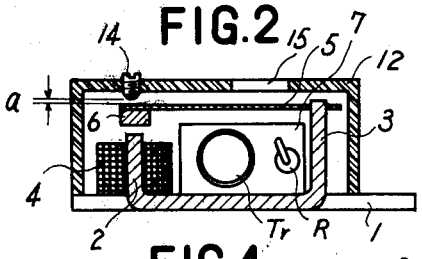
FIG. 2 is a sectional view taken along lines II—II in FIG. 1.

Refering now to the drawings, a base plate 1 is made with magnetic material. From the base plate 1, a yoke 2 and a vibrator support 3 are integrally formed and project upwards. A pick-up and driving coil 4 is provided round the yoke 2. A vibrator 5 carries a magnet 6 at its one free end portion, and is provided with a square hole 5*a* at its other end portion. The vibrator support 3 is provided with a complementary shaped projection 3*a* which is fit in the hole 5*a* thereby supporting the vibrator 5. A printed circuit board 7 is provided with, on its front side, a transistor Tr and a resistor R which are component parts of a driving circuit, and, on its back surface, a printed circuit pattern (not shown in the drawings) which connects terminals of the component parts. A set of lead wires 8, 9 are connected to power supply terminals of the printed circuit.

Figure 3:
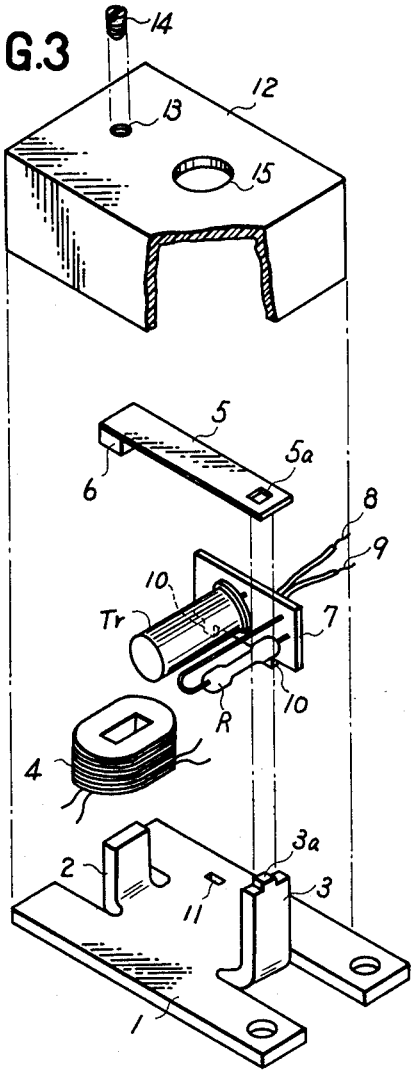
FIG. 3 is an exploded perspective view of the buzzer, partially broken away.

At the lower end portion of the printed circuit board 7, two depending projections 10, 10 are formed. The projections 10, 10 fit into holes 11, 11 provided in the base plate 1 (one of which can not be seen behind the vibrator support 3 in FIG. 3), and by means of an adhesive agent the printed circuit board 7 is fixed on the base plate 1. The transistor Tr and the resistor R are located between the yoke 2 and the vibrator support 3 thereby using space effectively. A case 12 is connected to the base plate 1 by an adhesive agent.

The case 12 is made of synthetic resin. In the case 12 is provided a threaded hole 13 into which is adjustably screwed an impact member in the form of a screw 14 for adjustably controlling the buzzer sound. The free end portion of the vibrator 5 is disposed adjacent to and facing the screw 14 leaving a little clearance "a" therebetween. A hole 15 is bored in the case 12 for permitting escape of the buzzer sound.

Figure 4:
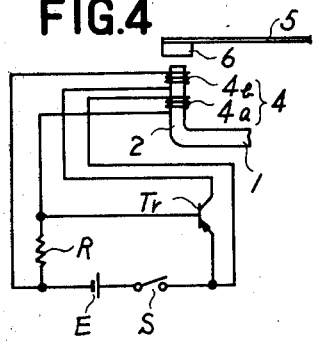
FIG. 4 is a driving circuit of the buzzer.

FIG. 4 shows a driving circuit. This circuitry is in itself well known and therefore will not be described in detail. The transistor Tr, resistance R, a pick-up coil 4*a* and a driving coil 4*b* are connected by means of the printed circuit to a power source E and a switch S.

Upon closing the switch S, the vibrator 5 is vibrationally driven to repeatedly strike the screw 14 with its free end portion producing a buzzer sound. The buzzer sound can be adjusted to the desired degree by varying the clearance "a" by selectively adjusting the depth of the screw 14.

What is claimed is:

1. In a buzzer: a vibrator mounted at one end to undergo vibration at its other free end; drive means for vibrationally driving said vibrator to effect vibration of the vibrator free end; an impact member disposed in the vibrational path of travel of the vibrator free end so as to be repeatedly struck thereby during vibration of said vibrator to produce a buzzer sound; and means mounting said impact member to enable selective positioning thereof along said path of travel in directions towards and away from said vibrator free end to accordingly selectively vary the buzzer sound, said means mounting said impact member comprising a screw thread on said impact member, and means defining a screw-threaded opening fixedly located relative to said vibrator and having said screw thread adjustably threaded therein so that turning of said impact member effects axial movement thereof and varies the point along said path of travel at which said vibrator free end strikes said impact member to accordingly vary the buzzer sound.

2. A buzzer according to claim 1; wherein said impact member comprises a threaded screw.

3. A buzzer according to claim 1; further including a case having said vibrator and drive means mounted therein and having said threaded opening formed in a wall portion thereof so that said impact member can be adjustably positioned from outside said case.

* * * * *